US005412366A

United States Patent [19]

Ohji et al.

[11] Patent Number: 5,412,366

[45] Date of Patent: May 2, 1995

[54] ROTARY TRANSFORMER

[75] Inventors: Toshio Ohji, Mito; Yuji Kanda, Tottori, both of Japan

[73] Assignee: Hitachi, Ltd., Japan

[21] Appl. No.: 170,697

[22] Filed: Dec. 21, 1993

[30] Foreign Application Priority Data

Dec. 21, 1992 [JP] Japan ..... 4-340497

[51] Int. Cl.[6] ..... H01F 21/04

[52] U.S. Cl. ..... 336/120; 336/200; 336/232

[58] Field of Search ..... 336/119, 120, 200, 232, 336/123, 115

[56] References Cited

U.S. PATENT DOCUMENTS 4,829,401 5/1989 Vranken ..... 361/836

5,239,288 8/1993 Tsals ..... 336/120

*Primary Examiner*—Leo P. Picard

*Assistant Examiner*—L. Thomas

*Attorney, Agent, or Firm*—Evenson, McKeown, Edwards & Lenahan

[57] ABSTRACT

A composite coil member for use in a rotary transformer is disclosed which is easily assembled and easily fitted in a transformer core of the rotary transformer. A plurality of coaxial conductive coils 4 are formed photolithographically on a plurality of coaxial portions of a flexible insulating member prepared by photolithography and the respective coaxial portions of the flexible insulating member are supported at at least three points on each coaxial portion by radially extending connecting portions 8 of the flexible insulating member.

7 Claims, 6 Drawing Sheets

ROTARY TRANSFORMER

BACKGROUND OF THE INVENTION

1. Field of the Invention

The present invention relates to a rotary transformer of disc type for use in an electromechanical apparatus such as video tape recorder or digital audio tape recorder for exchanging signal with respect to a rotary magnetic head of the electromechanical apparatus.

2. Description of Prior Art

A rotary transformer of this kind includes a stator and rotor cores of ferrite and coaxial coils fitted in coaxial grooves formed in facing surcaes of the respective ferrite core and various arts of forming and fitting such coaxial coils have been proposed. Typical examples of these arts will be described.

In a first conventional art, which is proposed in Japanese Patent Application Laid-open No. Hei 3-227003, a coil pattern including conductive coils and short-rings formed is on a base film adhered to a surface of a transformer core and, peeling the base film off, the coil pattern is transferred to the transformer core.

In a second conventional art proposed in Japanese Patent Application Laid-open No. Hei 1-130509 and particularly shown in FIG. 2 thereof, a composte coil member having conductive coils and short-rings is formed on a backing of a flexible sheet of insulating material, which has connecting portions for connecting and supporting the conductive coils and short-rings, is fitted in grooves formed in respective transformer cores.

In a third conventional art disclosed in Japanese Patent Application Laid-open No. Hei 2-308505, a plurality of composite coil members each including conductive coils are formed on a high molecular sheet by photolithography and the composite coil member composed of this sheet and the conductive coils is fitted in grooves formed in a transformer core while punching out the composite coil member from the sheet.

In a fourth conventional art disclosed in Japanese Patent Application Laid-open No. Sho 62-271406 and particularly shown in FIGS. 2 and 3 thereof, a composite coil member composed of conductive coil patterns formed on both surfaces of an insulating layer and electrically connected to each other through through-holes formed in the insulating layer is fitted in coaxial grooves formed in a transformer core.

In a rotary transformer including a composite coil member for signal transmission, which is composed of a flexible support member of insulating material and coils formed thereon by using photolithigraphy, and transformer cores each having grooves in which the composite coil member is fitted, the following points are important in views of assembling of the rotary transformer and performance thereof:

(a) Good pressure contact of the composite coil member to the grooves of the transformer core.

(b) No need of peeling the coil support member after the composite coil member is fitted in the grooves.

(c) Easiness of holding the coaxial conductive coils without deformation before fitting them in the grooves.

(d) Easiness of forming the coils and the coil support member having configuration met the groove configuration of the core.

(e) A desired number of turns of the conductive coil is obtainable within a limited area.

In the first conventional art mentioned above, the conductive coils formed on the base film are adhered to the transformer core and then transferred thereto by peeling the base film off. In transferring the coils, it is necessary to apply pressure thereto from the side of the base film. Therefore, there are problems, in transferring the coils to the grooves of the transformer core, that the coils can not received in the grooves of the core correctly due to rigidity of the base film and that the base film must be peeled off after the transfer.

In the second conventional art mentioned above, the connecting portions extend along the diameter direction and support each of the coaxial coils at two locations and the composite coil member is fitted in the grooves of the transformer core together with their the backing of the coaxial flexible insulating member. Assuming that the coils are for a rotary transformer of multi-channel type, radially outer coils may not be supported enough by the connecting portions since portions of the outer coils which are not supported by the connecting portion become substantially long and, thus, it is very difficult to support the coils without deformation as a whole. Although it may be considered, in order to support the coils reliably or to make the coils correspondent to lead portions of coil terminals in case of multi-channel type, that the connection portion is made wider. In such case, however, a facing area of the transformer core is reduced correspondingly, resulting in degradation of performance of the rotary transformer.

In the third conventional art mentioned above, a sheet film on which the composite coil members are formed is positioned and held at a predetermined location by means of positioning holes formed along the sheet. The sheet is punched at that location to cut out the composite coil member from the sheet in alignment with the grooves of the transformer core, and, simultaneously therewith, the punched coil member is adhered into the grooves. In this case, however, corner portions of the composite coil member which connects the radially extending coil terminal portions and the coaxially arranged arc portions of the composite coil member are rounded due to structural limitation of a punching die. Therefore, it is necessary to preliminarily make each of the groove of the transformer core wider. Consequently, an area of the coil member facing the opposite transformer core is reduced correspondingly, resulting in degradation of performance of the rotary transformer. When such coil member is of a type which contributes to miniturization of a rotary transformer or is of multi-channel type, gap between adjacent coils is small and gap between adjacent grooves of the core is small necessarily. Therefore, tolerance of registration between the coils on the sheet film and the grooves of the core becomes small. Consequently, the structure of the punching die becomes complicated, mechanical strength of the punching die is degraded and/or manufacture of the punching die becomes difficult.

In the fourth conventional art, the composite coil member composed of the flexible insulating layer and the coils formed on the both surfaces of the insulating layer is fitted in the grooves of the transformer core. In this technique, when the coils on these surfaces have the same number of turns and are formed in substantially the same region when looked from either surface of the insulating layer, and when the region covers the width of the flexible insulating layer substantially, the coil patterns on the both surfaces of the insulating layer may be deviated from each other by a distance in the order of 0.1 mm, since these coil patterns must be formed by photo-lithography separately, and, therefore, portions of the coil patterns on edge portions of the insulating layer may be thinned or broken.

SUMMARY OF THE INVENTION

An object of the present invention is to provide a high performance rotary transformer which includes at least a coil member including coils formed on a flexible insulating film by means of photo-lithigraphy and which is efficiently assembled owing to easiness of burying the coil member in a transformer core.

In an aspect of the present invention, conductive coils are formed, by photolithography, on coaxial portions of a flexible insulating member which are also formed by photolithography, and the respective coaxial portions of the flexible insulating member are supported at three locations by radially extending connecting portions of the flexible insulating member.

In another aspect of the present invention, conductive coils are formed, by photolithography, on coaxial portions of a flexible insulating member which are also formed by photolithography, and the respective coaxial portions of the flexible insulating member are supported at three locations by radially extending connecting portions of the flexible insulating member. Further, corner portions of the flexible insulating member at which the radially extending connecting portions and the coaxial arc portions thereof are joined are reccessed inwardly.

In a further aspect of the present invention, conductive coils are formed, by photolithography, on coaxial portions of a flexible insulating member which are also formed by photolithography, and the respective coaxial portions of the flexible insulating member are supported at three locations by radially extending connecting portions of the flexible insulating member. Further, portions of the coaxial portions of the flexible insulating member are partially removed in the vicinity of the connecting portions. Although the coaxial portions of the flexible insulating member are separated from each other by this partial cutting of the flexible insulating member, these portions are maintained in their patterns by the conductive coils formed on the surface thereof, resulting in a composite coil member composed of the coaxial portions of the flexible insulating member supported integrally by the radially extending connecting portions and the coaxial coils.

In a still further aspect of the present invention, conductive coils are formed, by photolithography, on coaxial portions of a flexible insulating member which are also formed by photolithography, and the respective coaxial portions of the flexible insulating member are supported at three locations by radially extending connecting portions of the flexible insulating member. The connecting portions are mechanically removed by such as punching when the composite coil member is fitted in grooves of a core.

In another aspect of the present invention, conductive coils are formed on both surfaces of a flexible insulating member such that patterns of them are not completely aligned when looked from either surface of the flexible insulating member.

In this regard, the number of turns of the conductive coil on one surface of the flexible insulating member is made different from that of the conductive coil on the other surface of the flexible insulating member.

Alternatively, width or gap of the conductive coil on one surface of the flexible insulating member is made different from that of the conductive coil on the other surface of the flexible insulating member.

In the rotary transformer according to the present invention, the coaxial conductive coils are formed photolithographically on the coaxial portions of the flexible insulating member prepared by photolithography and the respective coaxial portions of the flexible insulating member are supported at at least three points on each coaxial portion by radially extending connecting portions. Therefore, it is possible to reliably support the conductive coils backed with the coaxial portions without deformation and thus the positioning for fitting them in the grooves of the transformer core can be done precisely, resulting in an improvement of assembling operation. Further, since the conductive coils are not supported by a transfer member such as transfer film, it is unnecessary to peel such transfer member off during mounting of the coil members on the core. Therefore, the assembling reliability is improved. Further, by recessing the corner portions between the connecting portions of the flexible insulating member which extend radially and coaxial arc portions of the flexible insulating member or partially removing the coaxial arc portions in the vicinity of the connecting portions, it is possible to form the grooves of the core such that they have the minimum neccesary area and configuration accommodating to the composite coil member and thus to obtain effective facing areas of the transformer cores.

It becomes possible to provide the facing area of the core and to improve the performance of the rotary transformer by removing, in the step of burying coil members in coaxial grooves of the core, the connecting portions extending radially by means of mechanical means such as punching. Further, when the punching is performed for only thin connecting portions and portions having small width, a structure of a punching die therefor can be simplified.

When the conductive coils are to be formed on both surfaces of the coaxial arc portions of the flexible insulating member by photolithography, it is possible to increase the number of turns of the coil and/or reduce a d.c. resistance thereof within a certain range by making the number of turns of the conductive coil on one surface different from that of the coil on the other surface such that the conductive patterns of these coils when looked from either surface are not completely coincident or by making width or gap of the conductive pattern of the conductive coil on one surface different from that of the coil on the other surface. The d.c. resistance of the conductuve coils is important in the rotor side of the transformer which is connected to magnetic heads. By reducing the d.c. resistance of the conductive coils, it is possible to reduce transmission loss of signal in a low frequency band, as described in National Technical Report; vol. 18, No. 4, Aug. 1972, published by Matsushita Electric Industries.

DETAILED DESCRIPTION OF THE PREFERRED EMBODIMENTS

Embodiments of the present invention will be described with reference to the drawings.

Figure 1:
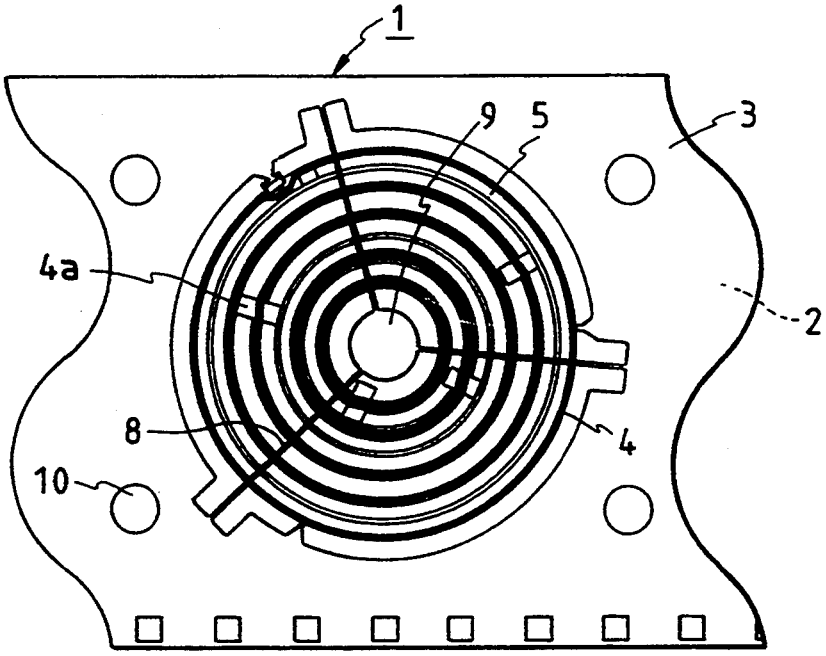
FIG. 1 is a plan view of a composite coil member for a rotary transformer according to a first embodiment of the present invention, looked from the side of a conductive coil.
Figure 2:
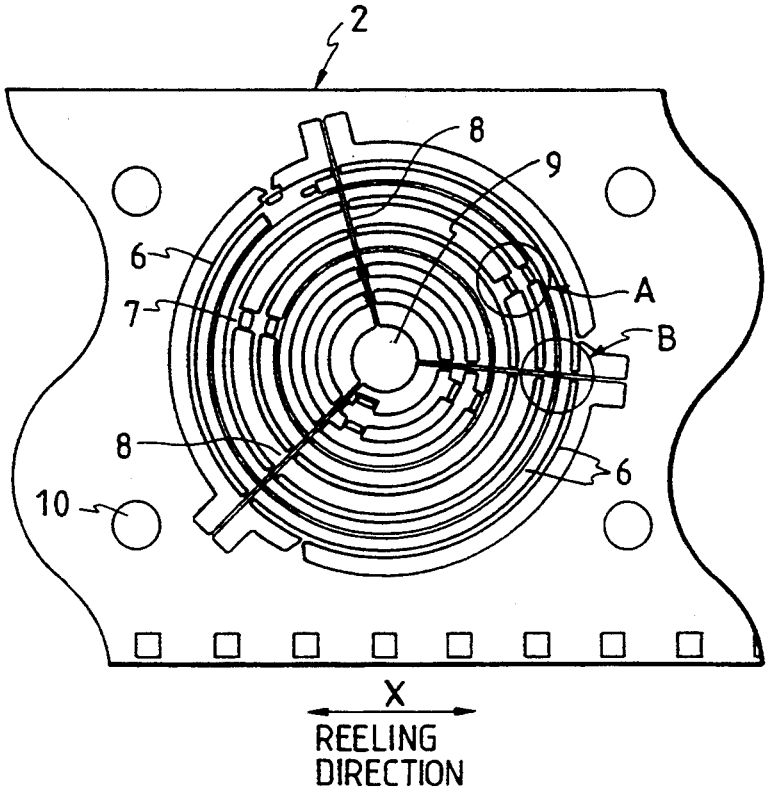
FIG. 2 is a plan view of the composite coil member shown in FIG. 1 with a conductive member being removed to show only a pattern configuration of a flexible insulating member.

FIG. 1 is a plan view of a composite coil member on the side of a stator which is composed of a flexible insulating member and conductive coils and short-rings formed on the flexible insulating member and constitutes a portion of a rotary transformer according to a first embodiment of the present invention and FIG. 2 is a plan view of the composite coil member shown in FIG. 1 with the conductive member being removed to show only the flexible insulating member for backing and supporting the conductive coils and the short-rings. FIGS. 1 and 2 show an example of 5-channel type in which 5 conductive coils and 2 short-rings are arranged in 7 grooves, respectively.

In a conventional method of obtaining conductive coils by utilizing photolithographic technology, it is usual to paint a surface of an electrically conductive member with photo sensitive resist material, pattern the thus formed resist film to a desired shape by exposure, remove a portion of the resist film on areas on which a conductive coil pattern and a short-ring pattern are to be formed and plate a portion of the conductive member having no resist film thereon with metal such as copper. Alternatively, it may be possible to obtain the conductive coils by removing other portion of the resist film provided by the same painting than the portion on which the conductive coil pattern and the short-ring pattern are formed, forming these patterns by removing the exposed conductive member by chemical etching and finally removing the remaining portion of the resist film.

The patterning of the flexible insulating member may be performed by utilizing the photolithographic technology through the steps of formation of the photo resist film, exposure of it with a predetermined pattern mask, removal of the unexposed portion thereof and removal of a portion of the exposed flexible insulating member by chemical etching.

In the coil member, that is, a composite coil member composed of the flexible insulating member, electrically conductive coils and short-rings, according to each of the respective embodiments of the present invention, the flexible insulating member and an electrically conductive member in the form of such as metal foil are patterned by using photolithographic technology as mentioned above. That is, a diuble layer substrate is formed by laminating and adhering an electrically conductive member such as metal foil or metal film of such as copper and the flexible insulating member of such as polyimide resin film, by painting a metal foil of such as copper with an insulating resin such as polyimide resin to a predetermined thickness as the flexible insulating member or by plating a flexible insulating member of polyimide resin with copper to a predetermined thickness and is chemically etched with using photolithographic technology followed by chemical etching of the flexible insulating member of the double layer substrate by using the photolithographic technology.

The composite coil member for signal transmission includes a plurality of coaxially arranged circular coils corresponding in configuration to respective circular grooves formed in a surface of a ferrite core such that these circular coils can be fitted in the respective circular grooves of the ferrite core. The composite coil member, before fitted in the grooves, is integral with the double layer substrate 1 as shown in FIG. 1. On the flexible insulating member 2 of the double layer substrate 1, a plurality (5, in this embodiment) of coaxially arranged conductive coils 4 formed of an electrically conductive member 3 and a plurality (2, in this embodiment) of coaxial short-rings 5 are formed with high precision by using photolithographic technology.

On the flexible insulating member 2, a plurality of coaxially arranged arc portions 6, a plurality of radially arranged coil terminal support portions 7 and a plurality (3, in this embodiment) of thin radial connecting portions 8 arranged with an angular interval of about 120° and extending substantially throughout the radius of the composite coil member, etc., are formed as shown in FIG. 2 by processing the flexible insulating member 2 precisely with using photolithoigrapic technology. The respective arc portions 6 of the flexible insulating member 2 serves as a backing for supporting the conductive coils 4 and the short-rings 5 and the coil terminal support portions 7 support coil terminal portions 4*a* of the conductive coils 4.

Further, the radially extending connecting portions 8 of the flexible insulating member 2 are extensions of a main portion of the double layer substrate 1 and cross the respective arc portions 6 substantially perpendicularly. Free ends of the connecting portions 8 are connected to a central connecting portion 9. Although the radially extending connecting portions 8 and the arc portions 6 are physically separated from each other for the reason to be described later, the arc portions 6 having the same radius are electrically connected to each other by the conductive member 3 including the conductive coils 4 and the short-rings 5 and the arc portions 6 and the radially extending connecting portions 8 are also electrically connected by the same, such that the composite coil member is reliably supported by the main portion of the double layer substrate 1 by means of the three radially extending connecting portions 8. Therefore, when the double layer substrate 1 is positioned with using positioning holes 10 and held in place, the conductive coils 4 and the short-rings 5 backed with the arc portions 6 of the flexible insulating member 2 are reliably supported by the radially extending connecting portions 8 without deformation or warping due to gravity.

Figure 3A:
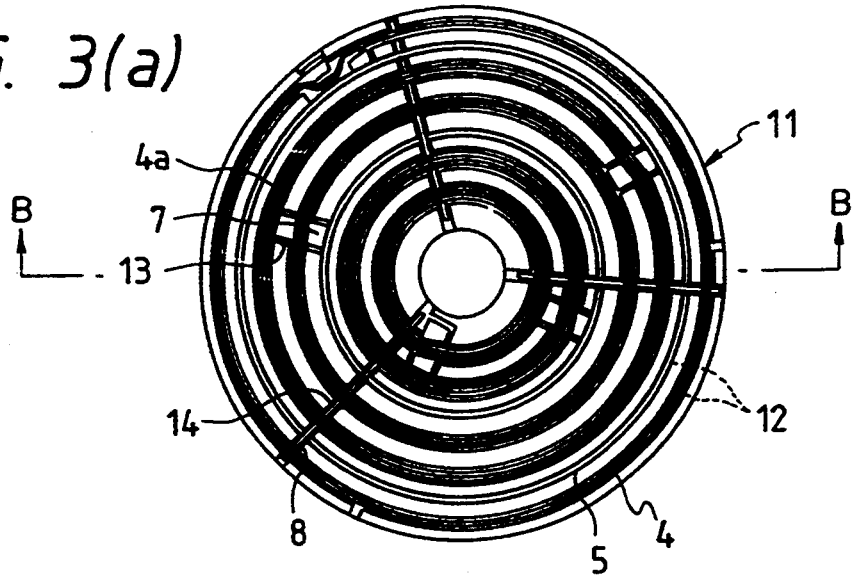
FIG. 3 shows a construction of a stator of the rotary transformer according to the first embodiment of the present invention.
Figure 3B:
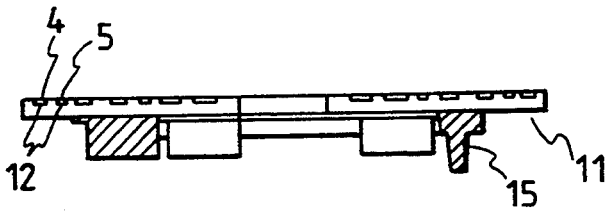
Figure 3C:
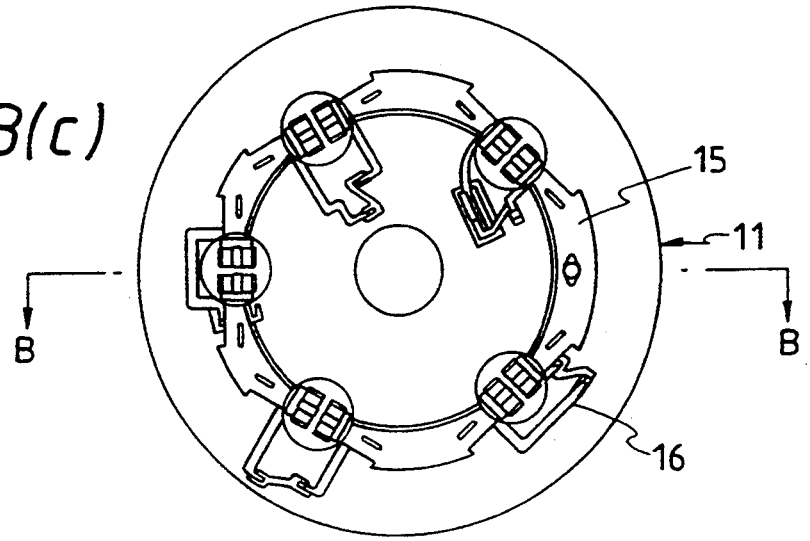

FIG. 3(*a*) is a plan view of a stator of the rotary transformer according to the first embodiment of the present invention, FIG. 3(*b*) is a cross section taken along a line b—b in FIG. 3(*a*) and FIG. 3(*c*) is a bottom view of the stator. The coil member formed in the double layer substrate 1 shown in FIG. 1 is positioned on a ferrite disc core 11 by utilizing a suitable transporting-/positioning mechanism together with the positioning holes 10 such that the flexible insulating member 2 thereof faces to the ferrite disc core 11. Then, the conductive coils 4 and the short-rings 5 are positioned on respective seven grooves 12 formed in an upper surface of the ferrite core 11, pushed into these grooves 12 by means of a suitable pressing mechanism and fitted therein by using the arc portions 6 backing the conductive coils 4 and the short-rings 5 as an adhesive layer. Similarly, the coil terminal support portions 7 and the radially extending connecting portions 8 are fitted in grooves 13 and 14 formed in the ferrite core 11, respectively. Further, during the fitting process of the composite coil member in the grooves of the ferrite core 11, portions of the radially extending connecting portions 8 connecting to the main portion of the double layer substrate 1 and connecting to the central connecting portion 9 are cut by press machining so that only necessary coil members are made integral with the ferrite core 11.

The coil terminal portions 4*a* of the respective conductive coils 4 fitted in the grooves of the ferrite core 11 are connected to respective conductive intermediate members 16 provided in a high molecular insulating member 15 fixed to a face of the ferrite core 11 opposite to a face thereof for signal transmission. That is, although not shown, the coil terminal portions 4*a* and the conductive intermediate members 16 are electrically connected by such as solder through through-holes provided in the ferrite core 11.

Figure 4:
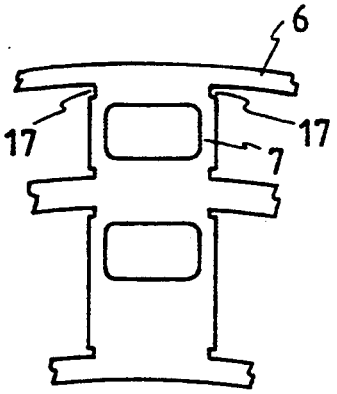
FIG. 4 shows a portion A in FIG. 2 in an enlarged scale.

FIG. 4 shows a portion A in FIG. 2 in an enlarged scale. In a portion in which the arc portion 6 of the flexible insulating member 2 is to be connected to the coil terminal support portion 7 substantially perpendicularly, a corner portion is hardly made at exact right angle and is usually rounded when they are formed by chemical etching. With such rounded corner, the groove of the ferrite core 11 must be sized to receive such rounded portion. This is unfavorable in view of performance of the rotary transformer since an effective facing area of the ferrite core is reduced. In order to solve this problem, recesses 17 are formed in corner portions of junctures between the arc portions 6 and the coil terminal support portion 7 of the flexible insulating member 2 by locally reccessing the corner portions, respectively, to exclude the undesirable effect of the rounded corners.

Figure 5:
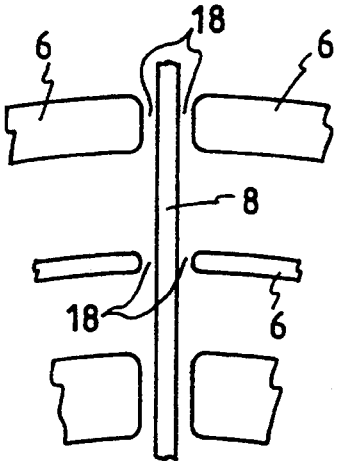
FIG. 5 shows a portion B in FIG. 2 in an enlarged scale.

FIG. 5 shows the portion B in FIG. 2 in an enlarged scale. Since the width of the radial connecting portion 8 around the junctures between it and the arc portions 6 is small, it is impossible to form such recesses as those formed in the corner portions in the junctures between the arc portions 6 and the coil terminal support portion 7 as shown in FIG. 4. According to this embodiment, slits 18 are formed in the junctures between the arc portions 6 and the radial connecting portion 8 so that there is no rounded corners.

The formation of the recesses 17 and the slits 18 are not limited to the corner portions as shown in FIGS. 4 and 5 and such recesses and/or slits can be formed in other portions than the corners so long as the configurations of the conductive coils 4 and the short-rings 5 can be maintained.

Figure 6:
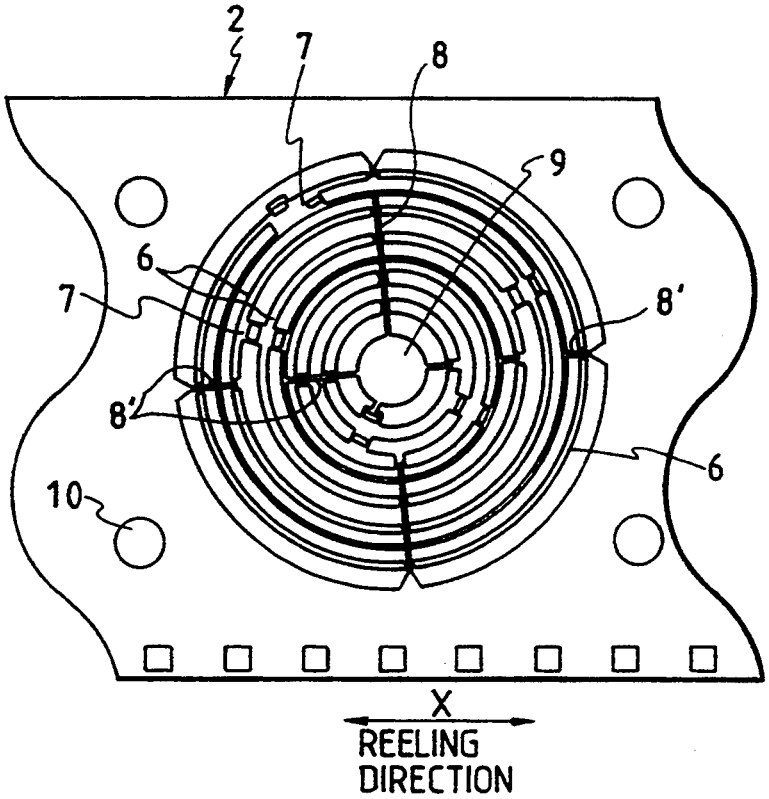
FIG. 6 is a plan view of a composite coil member for a rotary transformer according to a second embodiment of the present invention with a conductive member thereof being removed to show only a pattern configuration of a flexible insulating member.

FIG. 6 is a plan view of a double layer substrate on which a composite coil member is formed according to a second embodiment of the present invention, with a conductive member being removed to show a pattern formed in a flexible insulating member thereof. Although the radial connecting portions 8 are arranged with the interval of about 120 in the first embodiment, two of radial connecting portions 8 which extend radially substantially entirely are arranged with interval of about 180° and a plurality of short radial connecting portions 8' which extend radially partially are arranged between the radial connecting portions 8, in the second embodiment shown in FIG. 6. That is, in FIG. 6, a portion of the radial connecting portion around the coil terminal support portion 7 in the first embodiment is removed to the extent that the conductive coils 4 and the short-rings 5 are not deformed by gravity. The second embodiment can also support the conductive coils 4 and the short-rings 5 reliably without deformation.

It is usual that the double layer substrate 1 is handled as a roll during the manufacturing process of the composite coil member. Therefore, in order to prevent deformation of the respective portions of the composite coil members during manufacture, it is desirable to provide a larger number of coil terminal support portions 7 which are short in radial direction and function as radial connecting portions and a larger number of the radial connecting portions 8' in a reel direction shown by an arrow X in FIGS. 2 and 6 so that arc length of the arc portion 6 between the radial connecting portions 7 and 8' does not become too large.

Figure 7A:
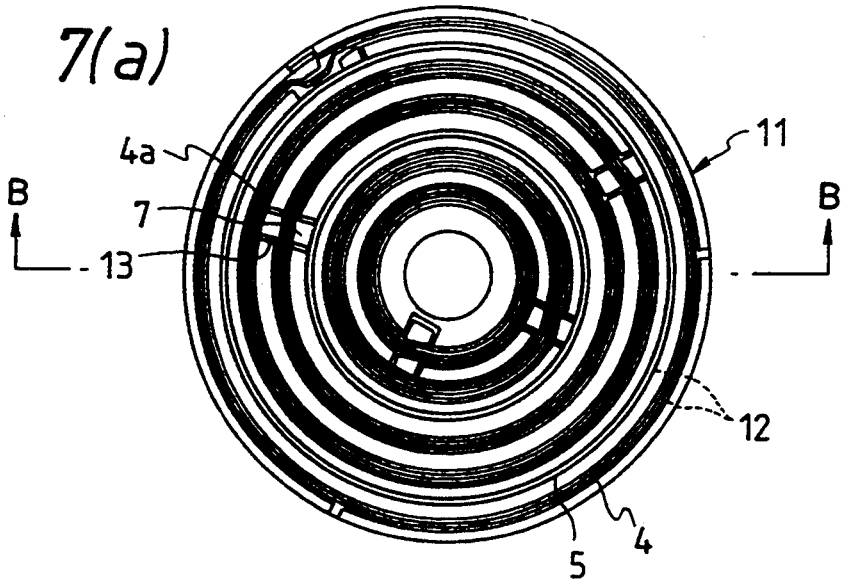
FIG. 7 shows a construction of a stator of the rotary transformer according to a third embodiment of the present invention.
Figure 7B:
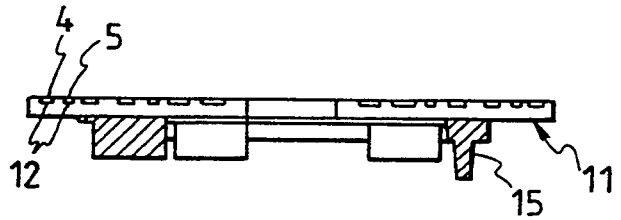
Figure 7C:
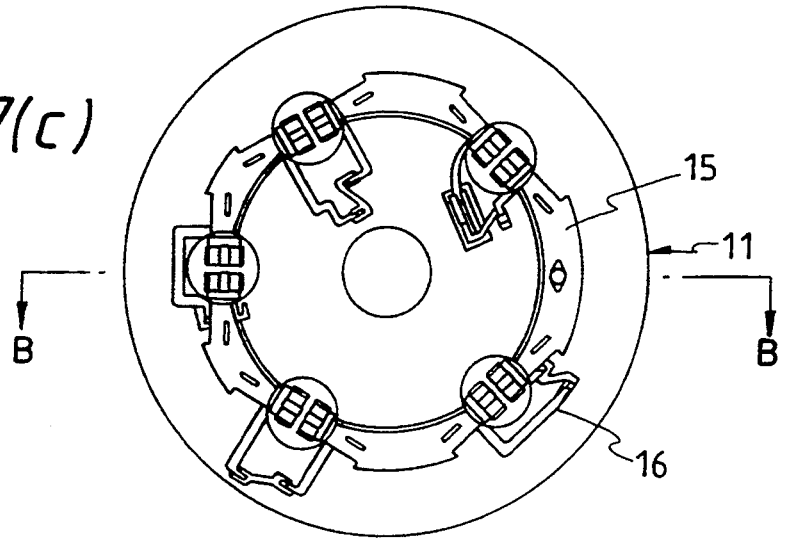

FIGS. 7(*a*) to 7(*c*) show a construction of a stator of a rotary transformer according to a third embodiment of the present invention, in which FIG. 7(*a*) is a plan view thereof, FIG. 7(*b*) is a cross section taken along a line b—b in FIG. 7(*a*) and FIG. 7(*c*) is a bottom view of the stator. Also in this embodiment, a double layer substrate 1 formed with coil members which is similar to that used in the first embodiment is used and respective portions of the composite coil members are fitted in and adhered to respective grooves of a ferrite core 11 in the similar manner to that used in the first embodiment. In this embodiment, however, grooves such as depicted by reference numeral 14 in FIG. 3 for receiving the radial connecting portions 8 are not formed in the ferrite core 11. That is, the radial connecting portions 8 are removed by punch-press simultaneously with fitting of the composite coil members in the grooves of the ferrite core 11. With this scheme, the effective facing area of the ferrite core 11 is more reliably maintained than in the first embodiment.

Figure 8:
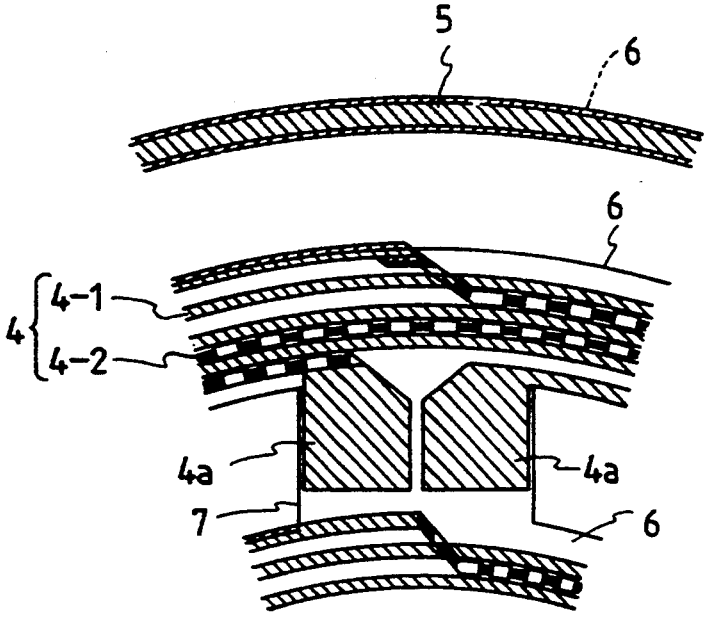
FIG. 8 is an enlarged view of a main portion of a composite coil member for a rotary transformer according to a fourth embodiment of the present invention.

FIG. 8 is an enlarged view of a main portion of a composite coil member according to a fourth embodiment of the present invention, showing a construction around coil terminal portions 4*a* of conductive coils 4 having conductor patterns 4-1 and 4-2 formed on both surfaces of coaxial arc portions 6 of a flexible insulating member 2, in which the conductive member formed on a front surface of the flexible insulating member 2 is shown by hatching and that formed in a rear surface is shown by black-and-white lines. The conductor pattern 4-1 formed on the front surface of a central arc portion 6 in FIG. 8 includes 4 turns and the conductor pattern 4-2 formed on the rear surface of the arc portion 6 and electrically connected to the conductor pattern 4-1 through through-holes which are formed in the double layer substrate and are not shown includes 2 turns, so that the conductor coil 4 includes a total of 6 turns. In the conductor coil 4 shown in FIG. 8, the coil terminal portions 4*a* which are a start and end points of the coil 4 are arranged inside of the coil 4. However, they can be arranged outside of the coil.

It is usual, in forming circuit patterns on both sides of a member within a predetermined area thereof, to form a circuit pattern on a front side first by using reference or positioning holes such as the positioning holes 10 mentioned previously and then to form a circuit pattern on a rear side with using the same positioning holes. However, some deviation of one pattern from the other is unavoidable practically and therefore such deviation must be considered in designing the pattern. It is assumed that deviation of a circuit pattern on one surface from a circuit pattern on the other surface is 0.1 mm. In such case, in order to precisely pattern the conductor pattern 4-2 on the rear side of the arc portion 6 of the flexible insulating member 2 without reduction of width thereof, it is necessary to design the conductor pattern 4-2 such that the latter is positioned within an area defined inside the arc portion 6 by at least 0.1 mm from peripheral lines (inner radius and outer radius) of the arc portion 6.

Figure 9:
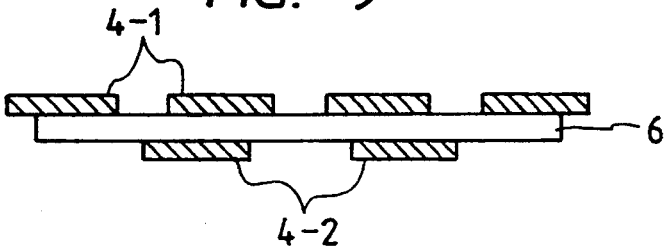
FIG. 9 is an enlarged cross sectional view of a main portion of the composite coil member for the rotary transformer according to the fourth embodiment of the present invention.

In the fourth embodiment of the present invention, as shown in FIG. 9 which is a cross section taken along a line 9—9 in FIG. 8, the number of turns of the conductor pattern 4-1 on a front surface of the arc portion 6 is made different from that of and the conductor pattern 4-2 on the rear surface thereof. That is, the pattern 4-1 includes 4 turns and the pattern 4-2 includes 2 turns and the conductor pattern 4-2 formed on the rear surface subsequent to the formation of the pattern 4-1 is defined inside of the outer edge of the arc portion 6 with a distance between the outer edge of the arc portion 6 and an outer edge of the conductor pattern 4-2 being 0.1 mm.

Figure 10:
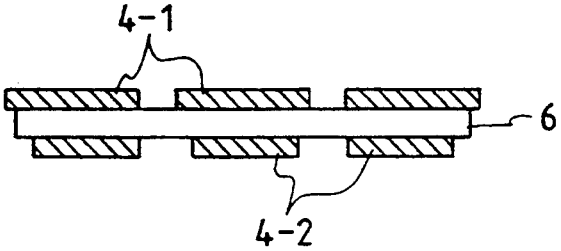
FIG. 10 is an enlarged cross sectional view of a main portion of a composite coil member for a rotary transformer according to a modification of the fourth embodiment of the present invention.
Figure 11A:
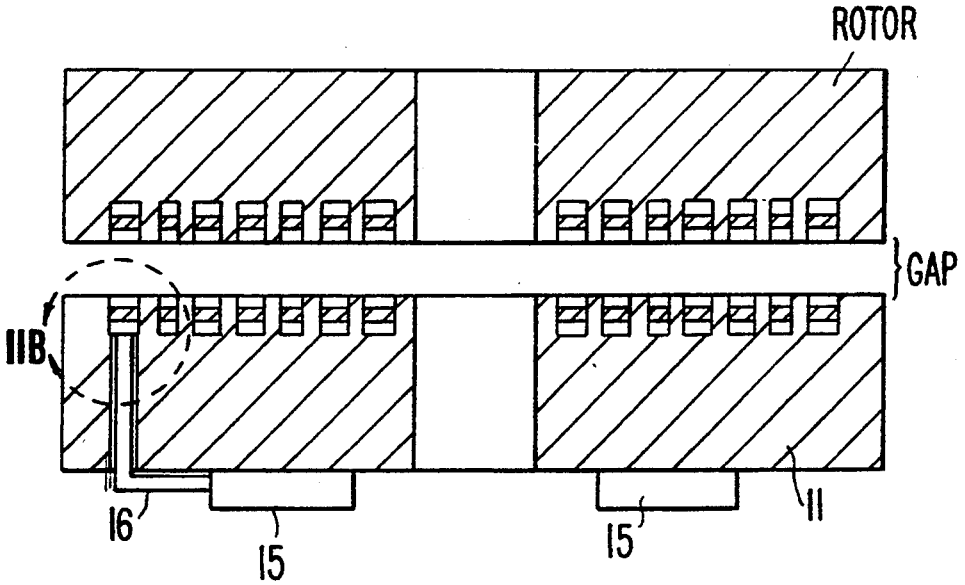
FIGS. 11A and 11B are, respectively, cross-sectional views of the stator of the present invention with an associated rotor, and an isolated portion of the former in the area designated by the dashed circle but on an enlarged scale.
Figure 11B:
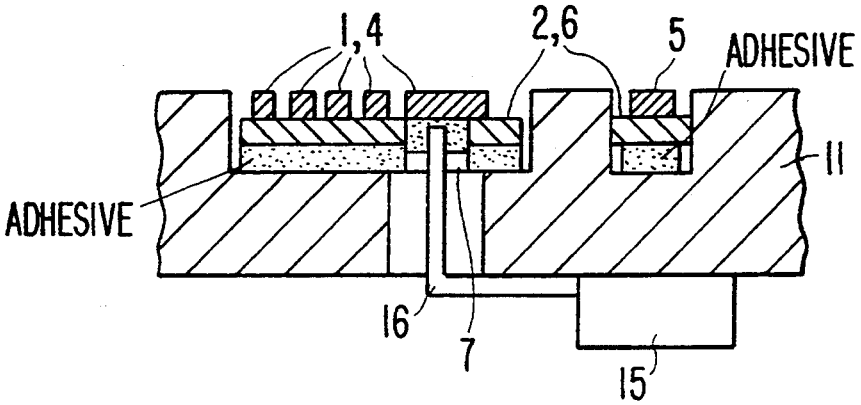

FIG. 10 shows a modification of the fourth embodiment. In this modification, the number of turns of the conductor pattern 4-1 on a front surface of the arc portion 6 is made equal to that of and the conductor pattern 4-2 on the rear surface thereof. That is, the patterns 4-1 and 4-2 include 3 turns, respectively. Width of conductor of the conductor pattern 4-2 is smaller than that of the conductor pattern 4-1 and interval between conductors of the pattern 4-2 is larger than that of the pattern 4-1, necessarily, so that the pattern 4-2 formed on the rear surface is defined inside of the outer edge of the arc portion 6 with a distance between the outer edge of the arc portion 6 and an outer edge of the conductor pattern 4-2 being 0.1 mm.

As described hereinbefore, the rotary transformer according to the present invention, in which the composite coil member for signal transmission which includes at least the conductive coils formed on the flexible insulating member by photolithography is fitted in the groove of the core of the transformer, is featured by the following points:

(1) A plurality of coaxial conductive coils are formed photolithographically on a plurality of coaxial portions of a flexible insulating member prepared by photolithography, respectively, and the respective coaxial portions of the flexible insulating member are supported at at least three points on each coaxial portion by radially extending connecting portions of the flexible insulating member. Therefore, it is possible to reliably support the conductive coils by the coaxial members without deformation and thus the positioning for fitting them in the grooves of the transformer core can be done precisely, resulting in an improvement of assembling operation.

(2) Since the conductive coils are not supported by a transfer member such as transfer film, it is unnecessary to peel such transfer member off during mounting of the coil members on the core. Therefore, the assembling reliability is improved.

(3) A highly precisely patterned flexible insulating member is obtained by inwardly reccessing corner portions between connecting portions of the flexible insulating member which extend radially and coaxial arc portions of the flexible insulating member or partially removing the coaxial arc portions in the vicinity of the connecting portions. Therefore, it is possible to relax the limiting conditions against the groove configuration of the core, that is, the facing area of the core, resulting in improved performance of a rotary transformer and improved assembling work therefor.

(4) It becomes possible to provide an enough facing area of the core and to improve the performance of the rotary transformer by removing, in the step of buring coil members in coaxial grooves of the core, the connecting portions extending radiall by means of mechanical means such as punching. Further, since the number of portions which are to be punched or cut is relatively small and very thin, it is possible to simplify the structure of punching dies.

(5) When conductive coils are to be formed on both surfaces of the coaxial arc portions of the flexible insulating member by photolithography, it is possible to increase the number of turnes of the coil and/or reduce a d.c. resistance thereof within a certain range by making the number of turns of the conductive coil on one surface different from that of the coil on the other surface or by making width or gap of the conductive pattern of the conductive coil on one surface different from that of the coil on the other surface such that the conductive patterns of these coils when looked from either surface are not completely coincident, resulting in stable conductive pattern and improved performance and reliability of a rotary transformer.

What is claimed is:

1. A rotary transformer comprising a rotor core having one surface formed with a plurality of coaxial grooves and at least three radially extending grooves, a stator core having one surface formed with a plurality of coaxial grooves and at least three radially extending grooves and facing to said one surface of said rotor core with a predetermined gap and signal transmission composite coil members fitted in said coaxial grooves formed in said one surfaces of said rotor core and said stator core for exchanging a signal by means of electromagnetic coupling between said rotor core and said stator core, each said composite coil member including a flexible insulating member having a plurality of coaxial arc portions, at least three connecting portions extending radially throughout said coaxial arc portions and a plurality of conductor coils and a plurality of short-rings formed coaxially on at least one surface of said flexible insulating member by means of photolithography, said stator core being formed with through-holes through which terminals of said conductor coils are led externally.

2. The rotary transformer claimed in claim 1, wherein corner portions of said flexible insulating member at which said radially extending connecting portions and the coaxial arc portions thereof are joined are reccessed.

3. The rotary transformer claimed in claim 1, wherein portions of said coaxial portions of said flexible insulating member are partially removed in the vicinity of the connecting portions.

4. The rotary transformer claimed in claim 1, wherein said connecting portions are configured to be mechanically removed when said composite coil member is fitted in said grooves of each said core.

5. A rotary transformer comprising a rotor core having one surface formed with a plurality of coaxial grooves and at least three radially extending grooves, a stator core having one surface formed with a plurality of coaxial grooves and at least three radially extending grooves and facing to said one surface of said rotor core with a predetermined gap and signal transmission composite coil members fitted in said coaxial grooves formed in said one surfaces of said rotor core and said stator core for exchanging a signal by means of electromagnetic coupling between said rotor core and said stator core, each said composite coil member including a flexible insulating member having a plurality of coaxial arc portions, at least three connecting portions extending radially throughout said coaxial arc portions and a plurality of conductor coils and a plurality of short-rings formed coaxially on both surfaces of said said flexible insulating member by means of photolithography, said conductor coils formed on one surface of said flexible insulating member being connected to said conductor coils formed on the other surface of said flexible insulating member through through-holes formed in said flexible insulating member, said stator core being formed with through-holes through which terminals of said conductor coils are led externally, coil patterns of said conductor coils formed on said surfaces of of said flexible insulating member being incompletely aligned with each other when looked from either surface of the flexible insulating member.

6. The rotary transformer claimed in claim 5, wherein the number of turns of said conductive coil formed on one of said surfaces of the flexible insulating member is made different from that of said conductive coil formed on the other surface of said flexible insulating member.

7. The rotary transformer claimed in claim 5, wherein the coil pattern of said conductive coil formed on one of said surfaces of the flexible insulating member is made different from that of said conductive coil formed on the other surface of said flexible insulating member.

* * * * *